US006137087A

United States Patent [19]

Tomatsu

[11] Patent Number: 6,137,087

[45] Date of Patent: Oct. 24, 2000

[54] THERMAL ROLLER FOR THERMAL FIXING DEVICE

[75] Inventor: Yoshiya Tomatsu, Nagoya, Japan

[73] Assignee: Brother Kogyo Kabushiki Kaisha, Nagoya, Japan

[21] Appl. No.: 09/220,704

[22] Filed: Dec. 24, 1998

[30] Foreign Application Priority Data

| | | | |
|---|---|---|---|
| Dec. 26, 1997 | [JP] | Japan | 9-360553 |
| Dec. 26, 1997 | [JP] | Japan | 9-360554 |
| Jan. 6, 1998 | [JP] | Japan | 10-000799 |

[51] Int. Cl.[7] ..... H05B 1/00; G03G 15/01

[52] U.S. Cl. ..... 219/216; 399/330

[58] Field of Search ..... 219/216, 469, 219/470, 471; 399/330, 335, 328; 432/60, 228; 492/46; 118/60

[56] References Cited

U.S. PATENT DOCUMENTS

| | | | |
|---|---|---|---|
| 3,629,549 | 12/1971 | Svendsen | 219/216 |
| 3,968,347 | 7/1976 | Isoard | 219/530 |
| 4,322,158 | 3/1982 | Frias et al. | 355/27 |
| 4,776,070 | 10/1988 | Shibata et al. | 29/130 |
| 4,888,464 | 12/1989 | Shibata et al. | 219/216 |
| 5,011,401 | 4/1991 | Sakurai et al. | 432/60 |
| 5,722,025 | 2/1998 | Morigami et al. | 399/330 |
| 5,724,638 | 3/1998 | Isogai et al. | 399/333 |
| 5,729,814 | 3/1998 | Suzuki et al. | 399/333 |
| 5,790,931 | 8/1998 | Tsuji et al. | 399/328 |

*Primary Examiner*—Teresa Walberg
*Assistant Examiner*—Daniel Robinson
*Attorney, Agent, or Firm*—Oliff & Berridge, PLC

[57] ABSTRACT

A heat-resistant insulation sheet 40 is formed from an insulation base 41 divided into an insulation region Z, a heat-generating region Y, and a pressing region X. The insulation base 41 is formed from a polyimide resin film member. A rectangular-shaped electrically-conductive resilient body 46 is attached on the pressing region X and a resistance-type heat-generating body 44 is attached on the heat-generating region Y. The resilient body 46 and the heat-generating body 44 are formed integrally from the same stainless steel plate, which is attached on the surface of the insulation base 41 and etched into a desired pattern. The heat-resistant insulation sheet 40 formed in this manner is mounted into a roller body in a rolled up condition with the pressing region X disposed interior to the heat-generating region Y, and the heat-generating region Y disposed interior to the insulation region Z.

10 Claims, 9 Drawing Sheets

THERMAL ROLLER FOR THERMAL FIXING DEVICE

BACKGROUND OF THE INVENTION

1. Field of the Invention

The present invention relates to a thermal roller used in a fixing device for fixing a thermally meltable recording material, such as toner, onto a recording sheet, such as a sheet of paper.

2. Description of the Related Art

There has been a fixing device used for fixing toner images onto a recording medium, such as a paper sheet. The fixing device is used in image forming devices such as electrophotographic printers and copiers. The fixing device is provided with a thermal roller. One frequently used thermal roller is formed from a stainless steel or aluminum tube with a halogen lamp disposed in its interior. The halogen lamp generates heat when illuminated. The heat from the halogen lamp heats the entire roller to a fixed temperature.

However, the halogen lamp is merely disposed in the center of the cylindrical tube and is not in intimate contact with the roller surface. Therefore, heat is inefficiently transferred from the halogen lamp to the cylindrical tube so that a great deal of time is required from when the halogen lamp is turned on until the thermal roller is heated up to a predetermined temperature required for fixing toner onto a recording sheet.

Japanese Patent-Application Publication (Kokai) Nos. HEI-9-138605 and HEI-9-179423 each disclose a thermal roller formed with a resistance-type heat-generating layer at its inner peripheral surface. The resistance-type heat-generating layer serves as a heat source for the thermal roller. As shown in FIGS. 1(*a*) to 1(*d*), the thermal roller is formed from a metal pipe 101; a resistance-type heat generating layer 102 including a heat-resistance insulation layer and a thermal heat-generating body disposed on the inner peripheral surface of the metal pipe 103; and a pressing body 103*a* or 103*b* mounted to the inner surface of the heat-resistant insulation layer 102. The heat-resistant insulation layer 102 is formed from a film member of polyimide, for example, and a thermal body fixed to the surface of the film member. The pressing body is formed from foam rubber or a hard foam resin material. Japanese Patent-Application Publication (Kokai) No. HEI-9-179423 describes the pressing body 103*a,* which as shown in FIGS. 1(*a*) and 1(*b*), has a solid columnar shape. Japanese Patent-Application Publication (Kokai) No. HEI-9-138605 describes the pressing body 103*b,* which as shown in FIGS. 1(*c*) and 1(*d*), has a hollow cylindrical shape.

Pressure within the foam rubber or the foam resin material of the pressing body 103*a,* 103*b* presses the heat-resistant insulation layer 102 against the metal pipe 101 to fix the heat-resistant insulation layer 102 against the metal pipe 101. The thermal body is pressed directly by the pressing body 103*a,* 103*b* into intimate contact with the inner peripheral surface of the metal pipe 101. With this configuration, heat from the thermal body is properly transmitted to the metal pipe 101.

Japanese Patent-Application Publication (Kokai) No. HEI-8-194401 discloses a thermal roller 110 shown in FIGS. 2 and 3. The thermal roller 110 includes a roller body 111 formed in a hollow cylindrical shape from a material having good thermal conductivity; a clinging prevention layer 112 formed on the outer peripheral surface of the roller body 111, and a resistance-type heating member 113 attached to the inner peripheral surface of the roller body 111.

The resistance-type heating member 113 includes an insulation film member 114 and a resistance-type heating body 117. The insulation film member 114 is formed from a polyimide resin film having heat resistance and electrical insulation properties. The resistance-type heating body 117 is a flexible heat-generating sheet attached onto the surface of the insulation film is member 114 and is configured from a resistance member 117*a* and electrodes 117*b*. The resistance member 117*a* is formed from a single or a plurality of stainless steel or copper foil films etched to a predetermined pattern on the insulation film member 114. The electrode 117*b* is provided for supplying power to both terminals of the resistance member 117*a*. The cross-sectional area of the resistance member 117*a* changes in the axial direction of the roller body 111 in order to adjust the temperature at the outer peripheral surface of the roller body 111 to a uniform temperature.

The thermal roller disclosed in Japanese Patent-Application Publication (Kokai) No. HEI-8-194401 is assembled by first coating a heat-resistant adhesive, which has no adhesive properties at room temperature, to the inner surface of the insulation film member 114. The insulation film member 114 is then inserted into the roller body 111. Next, the resistance-type heating member 113 is brought into contact with the inner peripheral surface of the roller body 111 using air pressure and the like. Then, the resistance-type heating member 113 and the roller body 111 are heated and fixedly adhered to each other in a high temperature oven.

Because the resistance-type heating member 113 is configured from a heat-generating sheet formed by prefixing the resistance-type heating body 117 onto the insulation film member 114. when the thermal roller 110 is assembled, operations for fixing the resistance-type heating member 113 to the roller body 111 can be easily performed. However, it would be desirable if the number of steps in the assembly process could be decreased or the steps further simplified somehow.

SUMMARY OF THE INVENTION

Because the pressure body 103*a,* 103*b* described in Japanese Patent Application Publication (Kokai) Nos. HEI-9-138605 and HEI-9-179423 is formed from a foam resin material, the surface confronting the heat-generating body is filled with air pockets. When pressing force is insufficient to press the resin material into contact with the heat-generating body, the resin material and the heat-generating body will be separated by air spaces at the air pocket portions. Since air has poor thermal conductivity, heat generated by the heat-generating body will remain in the air pocket portions at the surface of the heat-generating body, untransmitted to the foam resin material. This results in the heat generating body heating up excessively at localized areas.

It is conceivable to provide a safety device adjacent to the roller body for detecting unusually excessive heat and, under this condition, cutting off power supply to the heat-generating body. However, a safety device is only be able to monitor temperature at a position adjacent to where the safety device is located. That is, the safety device can not detect rapid temperature changes at positions on the outer surface of the aluminum roller even a small distance from where it is positioned. If the safety device does not cut off power to the heat-generating body, despite such a rapid temperature change, the foam resin material can thermally break down and, in the worst case, ignite.

That is to say, the polyimide and the like used to form the heat-resistant insulation layer has insulation and mechanical strength guaranteed to a heat resistance of 500° C. In contrast with this, silicone sponge and the like used in foam resin materials has a low heat resistance of between 350 to 360° C. Therefore, the silicone sponge will quickly thermally break down if, because the pressure body 103 has insufficient pressing force or for some other reason, the resistance-type heating body generates an unusually excessive heat. When the silicone sponge thermally breaks down, the molecular structure of the silicone sponge changes so that resilience of the silicone sponge drops. As a result, the silicone sponge will not press the heat-resistant resin layer 102 of the heat-generating body sufficiently into intimate contact with the inner peripheral surface of the metal pipe 101 to enable easy transmission of heat from the heat-generating body to the metal pipe 101. Since the heat from the heat-generating body is not properly discharged, the heat-generating body becomes increasingly overheated so that the polyimide of the pressure body 103 melts. The insulation between the heat-generating body and the metal pipe breaks down so that electric leaks occur and fire can occur.

This series of events occurs instantaneously once the silicone sponge thermally breaks down. As described above, it is conceivable to provide an overheat detection temperature sensor for detecting excessive heat of the roller. However, because the silicone sponge can instantaneously break down because of localized overheating, a plurality of overheat detection temperature sensors must be provided for detecting temperature across the entire internal surface of the roller in order to sense this overheating before larger problems occur. Technical problems and excessive costs make this option undesirable.

It is an objective of the present invention to provide an extremely safe thermal roller with a pressing member that will not thermally break down or ignite even when the roller generates excessive amounts of heat, even at only certain positions. It is another objective of the present invention to provide a thermal roller that can be easily assembled with lower cost.

To achieve the above-described objectives, a thermal roller according to one aspect of the present invention includes a cylindrical roller body formed with a hollow interior and a resistance-type heat generating body disposed in the hollow interior of the roller body. A first heat-resistant insulation layer is disposed between the roller body and the resistance-type heat generating body. Moreover, a second heat-resistant insulation layer is disposed interior to the resistance-type heat generating body. A resilient body is disposed interior to the second heat-resistant insulation layer. The resilient body presses the second heat-resistant insulation layer toward the roller body with sufficient resilient force to fix the first heat-resistant insulation layer. The resistance-type heat generating body, and the second heat-resistant insulation layer in place with respect to the roller body.

Because the second heat-resistant insulation layer is interposed between the pressing resilient body and the resistance-type heat-generating body, heat generated by the resistance-type heat-generating body is prevented from being transmitted directly to the pressing resilient body.

It is desirable that the second heat-resistant insulation layer have heat resistance equal to or greater than heat resistance of the first heat-resistant insulation layer. In this case. The second heat-resistant insulation layer, which functions as a heat insulation layer, can be prevented from thermally breaking down itself, thereby further assuring safety.

It is also desirable that the second heat-resistant insulation layer has greater heat resistance than the pressing resilient body. With this configuration, even when the resistance-type heat-generating body generates an excessively large amount of heat, thermal break down of the second heat-resistant insulation layer will not occur before thermal break down of the pressing resilient body. Because the second heat-resistant insulation layer will always be present without thermally breaking down, it will always properly restrict the amount of heat transmitted to the pressing resilient body, so that thermal break down of the pressing resilient body can be prevented.

The pressing resilient body is desirably formed from a thin plate shaped electrically-conductive resilient body rolled into a tube. With this configuration, the pressing resilient body has excellent thermal conductivity and, because of its small heat capacity, good temperature saturation. That is to say, even if the resistance-type heat-generating body, which is disposed exterior of the pressing resilient body, generates high localized temperatures, the generated heat will be dispersed over and saturate the entire electrically conductive resilient body. For this reason, the thermal roller is effectively prevented from locally heating to unusually high temperatures so that the temperature at the surface of the thermal roller will be even.

It is desirable that the electrically-conductive resilient body has thermal conductivity greater than the thermal conductivity of the second heat-resistant insulation layer. In this case, the electrically-conductive resilient body can remove a portion of any heat developed locally at the second heat-resistant insulation layer. The heat will disperse uniformly throughout the entire electrically-conductive resilient body. After this heat saturates the interior of the electrically-conductive resilient body, the dispersed heat is transmitted back to the second heat-resistant insulation layer. Accordingly, even if the material used as the heat-resistant insulation layer has poor thermal conductivity and tends to trap heat in local pockets, heat will be dispersed uniformly over the entire roller body via the heat-resistant insulation layer so that temperature unevenness does not occur.

Because the electrically-conductive resilient body has excellent heat resistance, the thermal roller is extremely safe. That is, the electrically-conductive resilient body can heat up very quickly because of its excellent thermal conductivity. If the electrically-conductive resilient body had poor heat resistance, then it might quickly heat to its combustion point. The second heat-resistant insulation layer 35 might be damaged if the electrically-conductive resilient body combusts before the safety device is activated. Therefore, when the electrically-conductive resilient body has excellent thermal conductivity, there is a need to prevent the electrically-conductive resilient body itself igniting. The high heat resistance of electrically-conductive resilient body prevents this.

According to a second aspect of the present invention, a thermal roller includes a cylindrical roller body formed with a hollow interior and a heat-resistant insulation sheet having an insulation region and a heat-generating region. The heat-generating region is at least partially covered with a resistor generating heat when energized. The heat-resistant insulation sheet is disposed in a rolled up condition in the hollow interior of the roller body with the heat-generating region disposed interior to the insulation region.

Because the heat-resistant insulation sheet has a heat-generating region and an insulation region, processes for assembling the thermal roller can be simplified compared to when separate parts are provided for each different function. Also, because the heat-resistant insulation sheet is mounted in the roller body in a rolled up condition with the insulation region to the inside of the heat-generating region, assembly operations can be performed more efficiently. As a result, the cost for assembling the thermal roller can be reduced.

According to a third aspect of the present invention a thermal roller includes a cylindrical roller body formed with a hollow interior and a heat-resistant insulation sheet having a heat-generating region and a pressing region. The pressing region is at least partially covered with a plate-shaped resilient body. The heat-resistant insulation sheet is disposed in a rolled up condition in the hollow interior of the roller body with the pressing region disposed interior to the insulation region.

Because the pressing means is provided for pressing the heat-resistant insulation sheet, which serves as the heat-generating layer, toward the inner peripheral surface of the roller body, the heat-resistant insulation sheet can be easily and uniformly fixed into intimate contact with the inner peripheral surface of the roller body without using adhesive. Because, partial contact is prevented, good heating properties are obtained. Also, as in the case of the second aspect of the present invention, processes for assembling the thermal roller can be simplified compared to when separate parts are provided for each different function. Also, assembly operations can be performed more efficiently. As a result, the cost for assembling the thermal roller can be reduced.

With the third aspect of the present invention, it is desirable that the heat-generating region and the pressing region each have a length at least as long as the inner circumference of the roller body. With this configuration, the heat-generating region can uniformly heat the inner peripheral surface of the thermal body. Also, the pressing region can press the heat-generating region with a uniform pressing force across the inner peripheral surface of the roller body so that the heat-generating region is effectively fixed to the inner peripheral of the roller body. Accordingly, the thermal roller according to the present invention has uniform temperature distribution and excellent safety characteristics.

BRIEF DESCRIPTION OF THE DRAWINGS

The above and other objects, features and advantages of the invention will become more apparent from reading the following description of the preferred embodiment taken in connection with the accompanying drawings in which:

FIG. 1(*b*) is a cross-sectional view taken perpendicular to the imaginary rotational axis of the thermal roller shown in FIG. 1(*a*);

Figure 1:
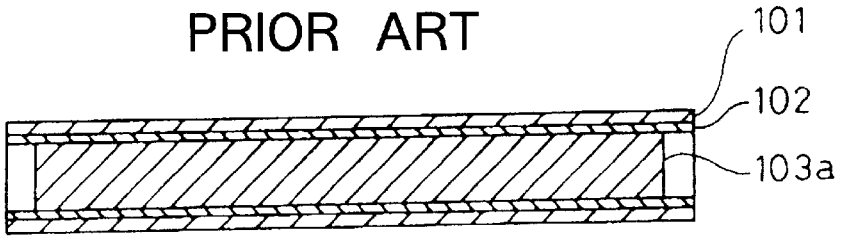
FIG. 1 (a) PRIOR ART
FIG. 1(*a*) is a cross-sectional view taken along an imaginary rotational axis of the thermal roller described in Japanese Patent-Application Publication (Kokai) No. HEI-9-179423.
Figure 1:
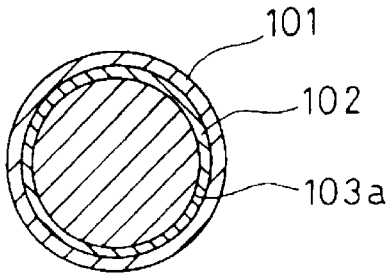
FIG. 1 (b) PRIOR ART
Figure 1:
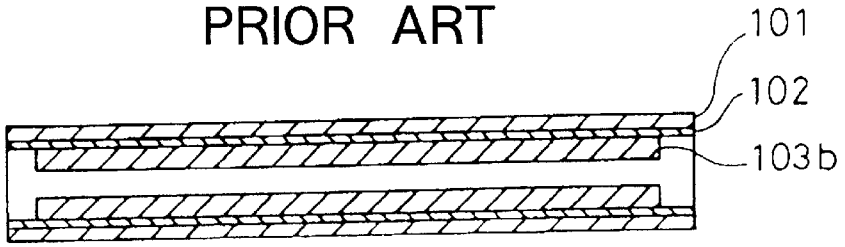
FIG. 1 (c) PRIOR ART
Figure 1:
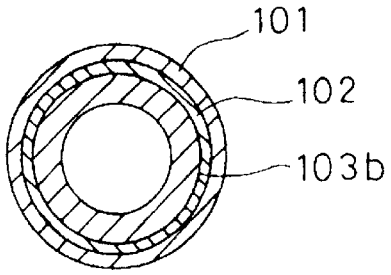
FIG. 1 (d) PRIOR ART
Figure 2:
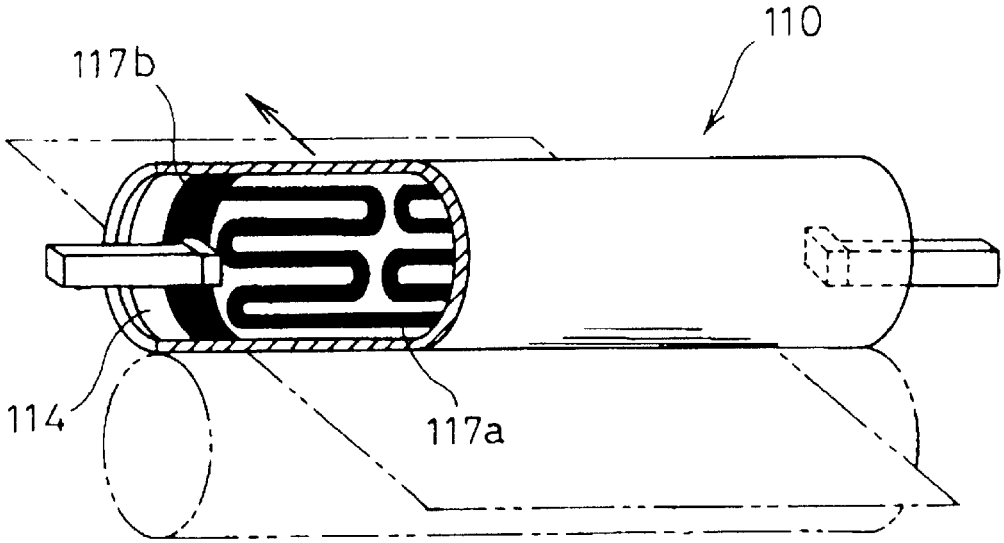
FIG. 2 PRIOR ART
Figure 3:
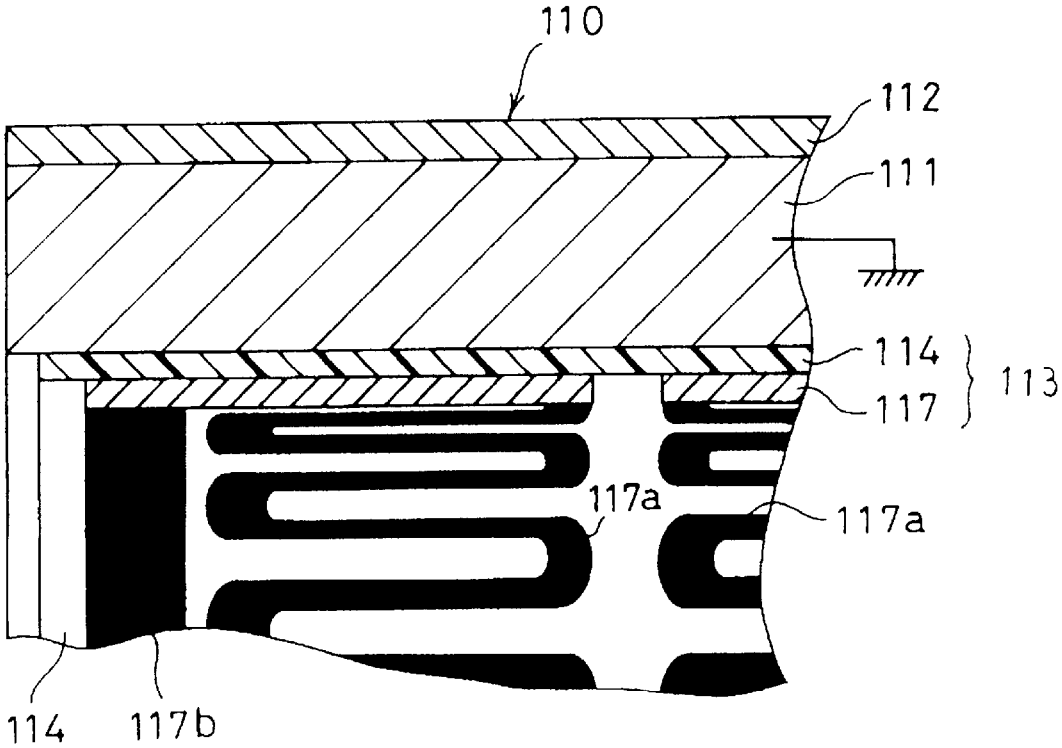
FIG. 3 PRIOR ART
Figure 4:
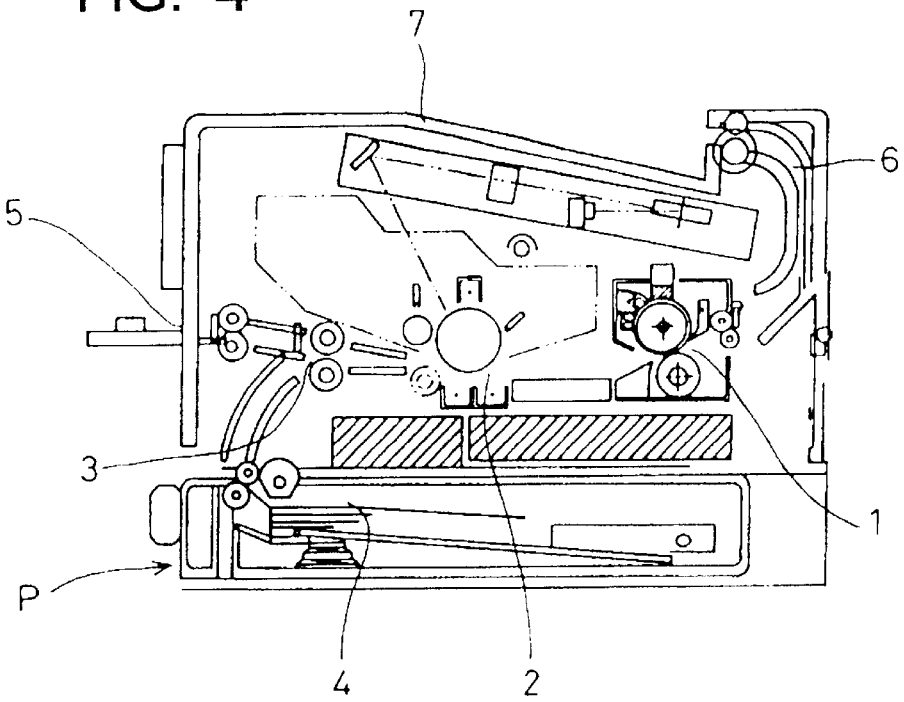
Figure 5:
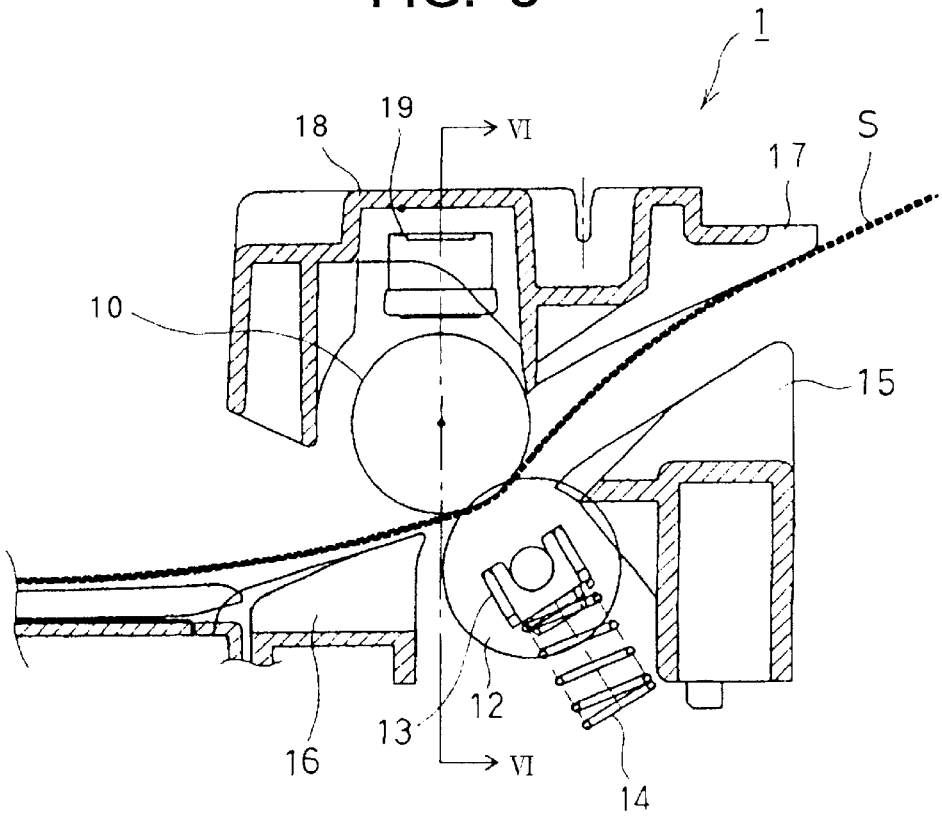
Figure 6:
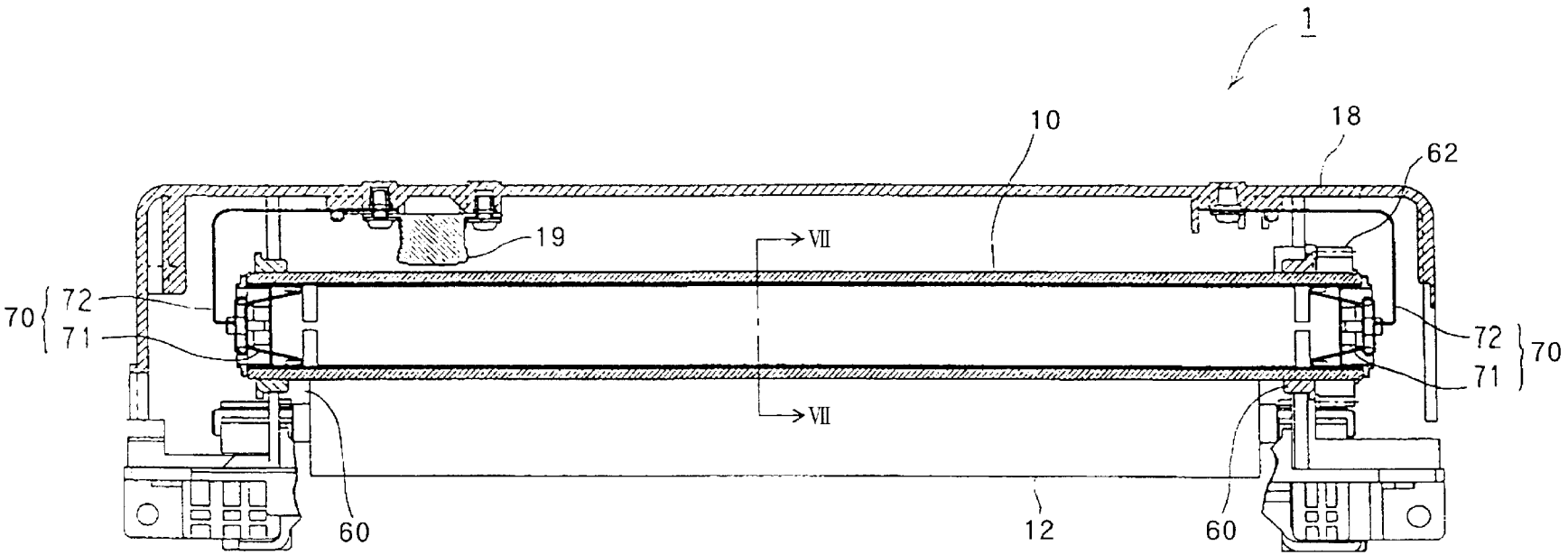
Figure 7:
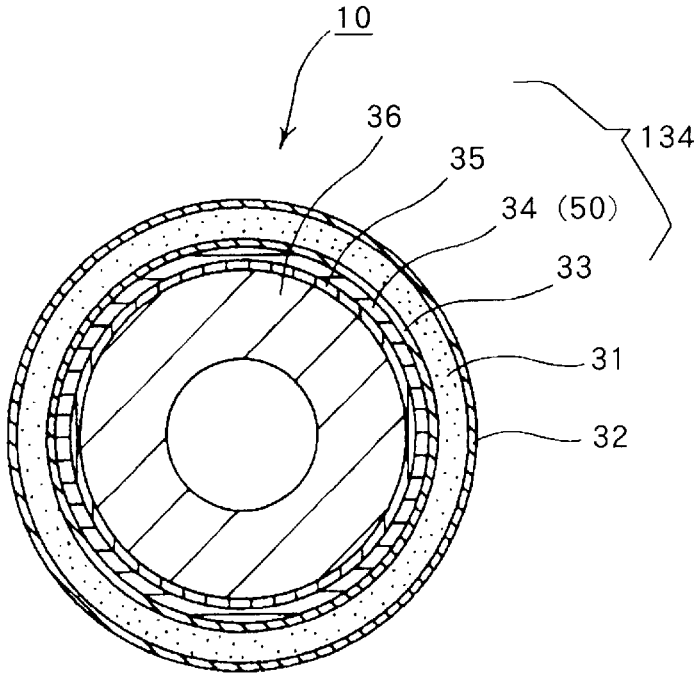
Figure 9:
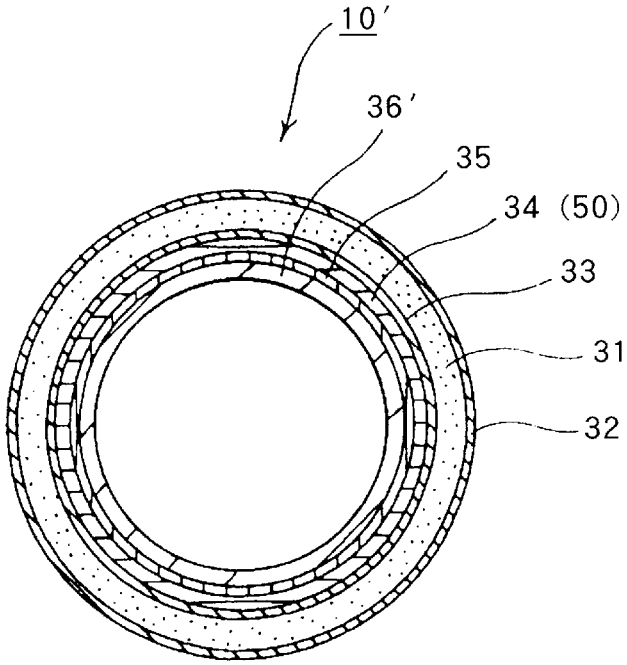
Figure 8:
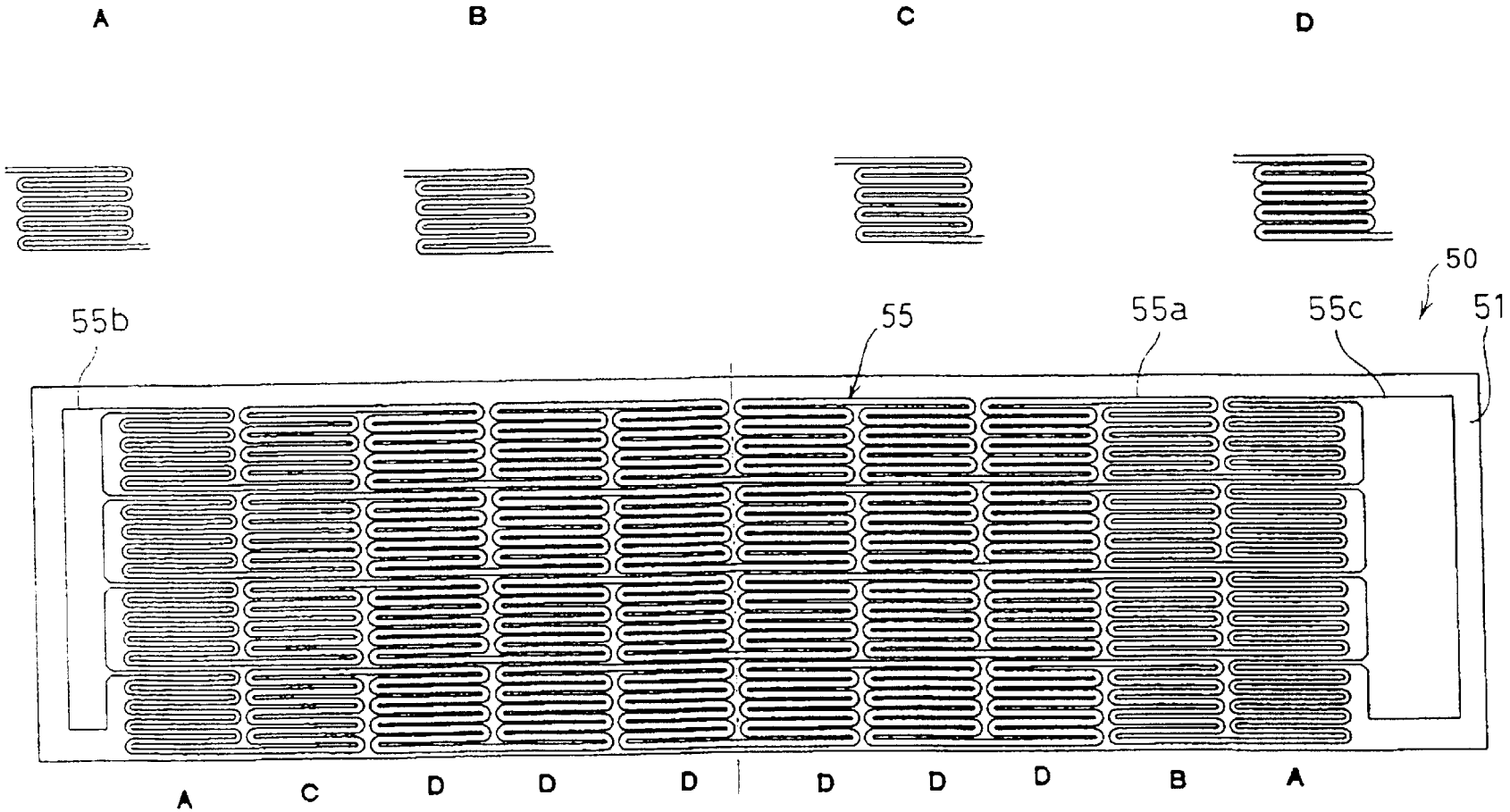
Figure 10:
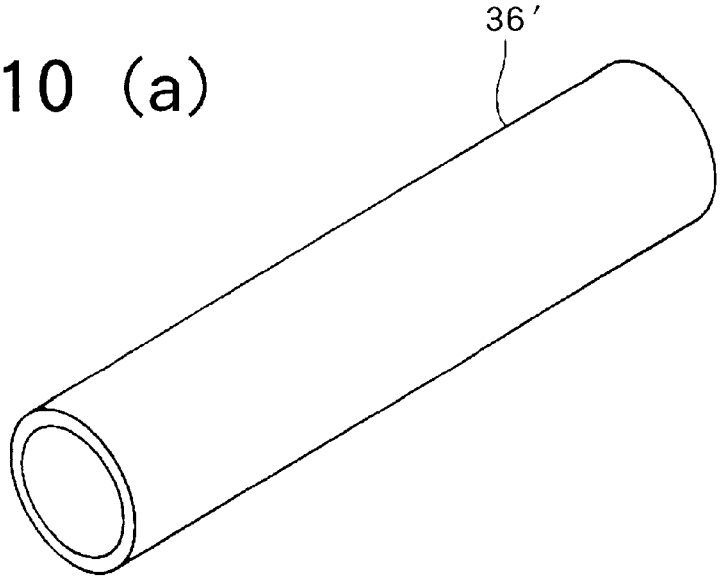
Figure 10:
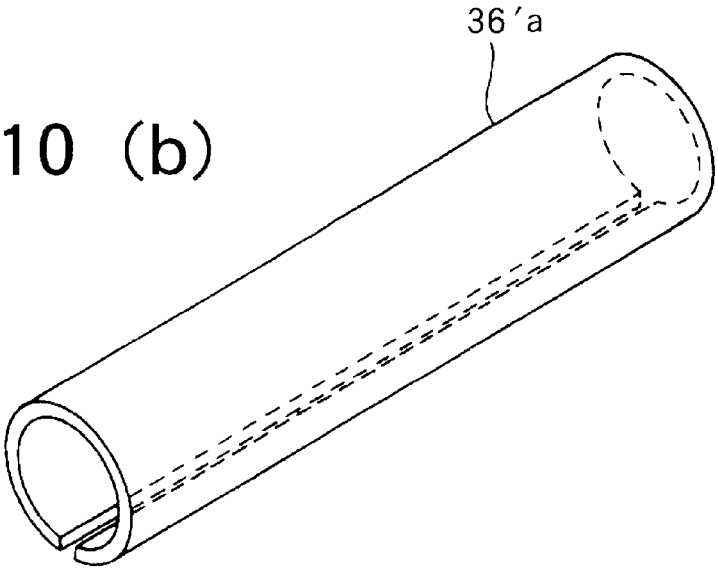
Figure 10:
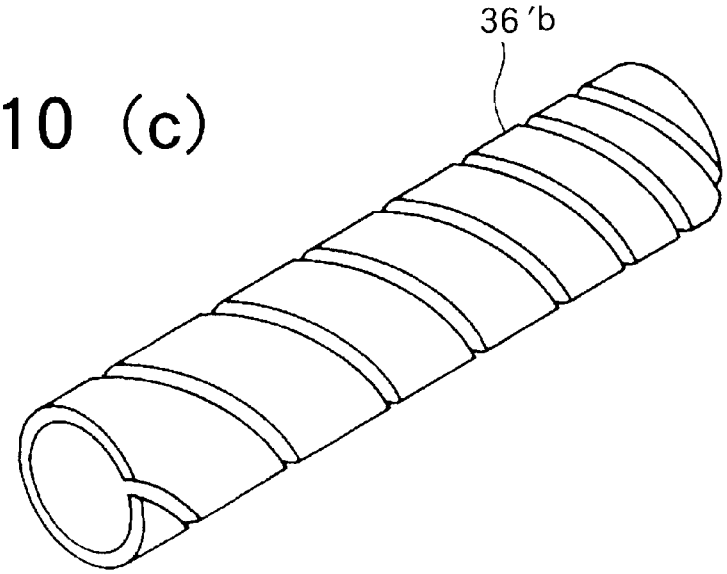
Figure 11:
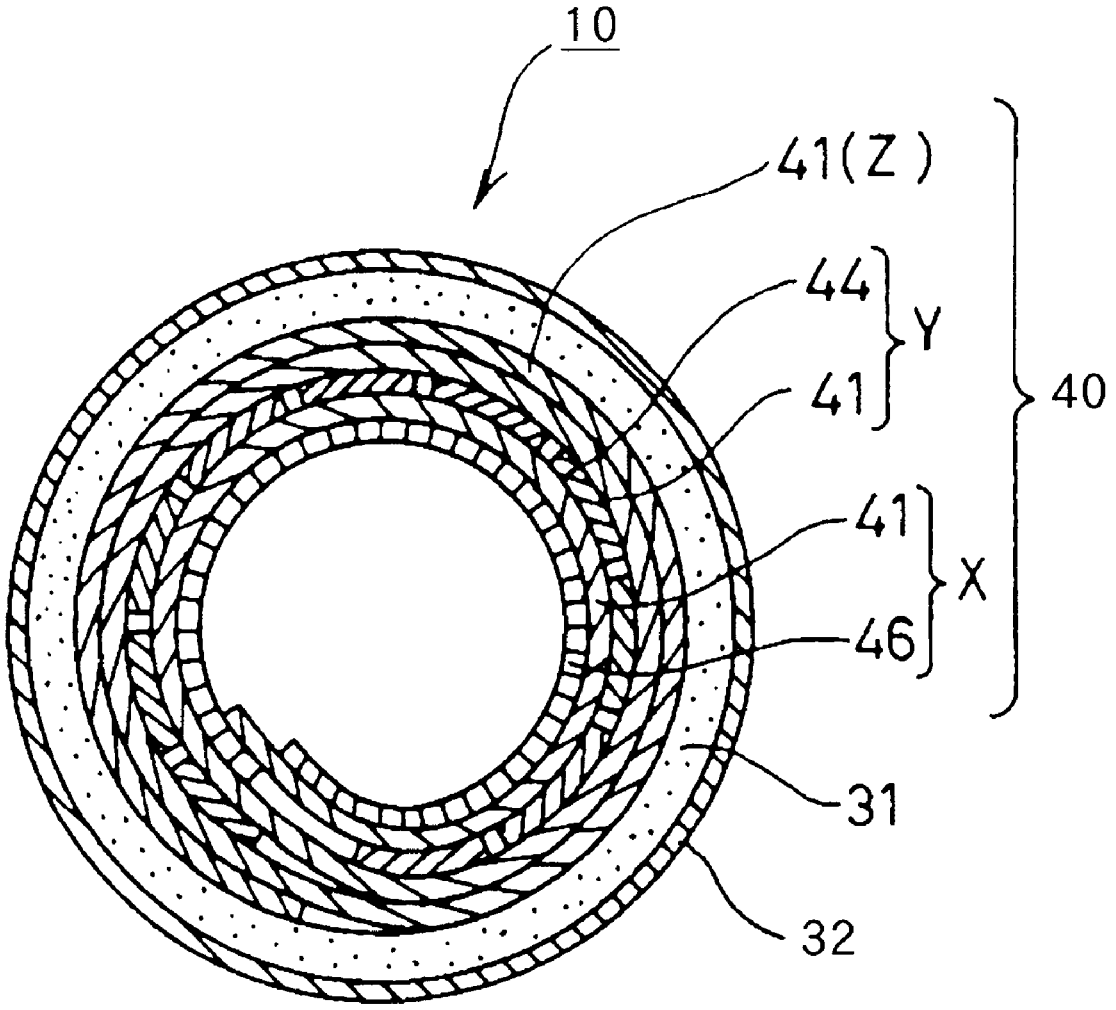
Figure 12:
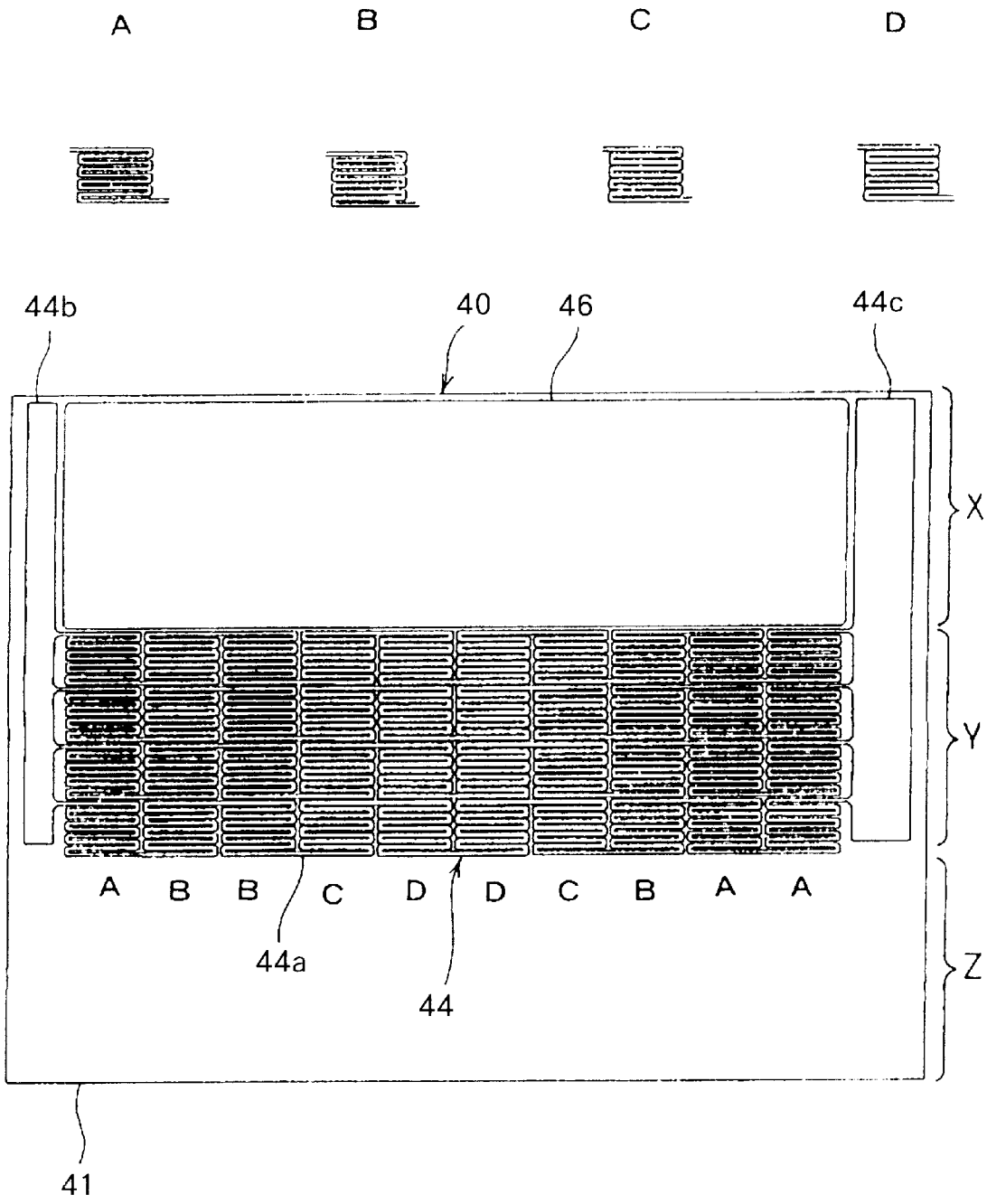

FIG. (*c*) is a cross-sectional view taken along an imaginary rotational axis of the thermal roller described in Japanese Patent-Application Publication (Kokai) No. HEI-9-138605;

FIG. 1(*d*) is a cross-sectional view taken perpendicular to the imaginary rotational axis of the thermal roller shown in FIG. 1 (*c*);

FIG. 2 is a perspective view in partial cross section showing a thermal roller disclosed in Japanese Patent Application Publication (Kokai) No. HEI-8-194401;

FIG. 3 is a magnified view showing essential configuration in cross section of the thermal roller shown in FIG. 2;

FIG. 4 is a cross-sectional view schematically showing a laser printer including a thermal fixing roller according to a first embodiment of the present invention;

FIG. 5 is a magnified cross-sectional view showing a fixing device including the thermal fixing roller according to the first embodiment;

FIG. 6 is a cross-sectional view taken along line VI—VI of FIG. 5;

FIG. 7 is a cross-sectional view of the thermal fixing roller taken along line VII—VII of FIG. 6:

FIG. 8 is a plan view showing a sheet-shaped thermal body of the thermal roller shown in FIG. 7;

FIG. 9 is a cross-sectional view showing internal configuration of a thermal roller according to a second embodiment of the present invention;

FIG. 10(*a*) is a perspective view showing an example of a electrically-conductive resilient body of the thermal roller according to the second embodiment;

FIG. 10(*b*) is a perspective view showing another example of the electrically-conductive resilient body of the thermal roller according to the second embodiment;

FIG. 10(*c*) is a perspective view showing still another example of the electrically-conductive resilient body of the thermal roller according to the second embodiment;

FIG. 11 is a cross-sectional view showing internal configuration of a thermal roller according to a third embodiment of the present invention; and FIG. 12 is a plan view showing a heat-resistant insulation sheet of the thermal roller according to the third embodiment of the present invention.

DETAILED DESCRIPTION OF THE PREFERRED EMBODIMENTS

A laser printer P including a fixing device 1 according to a first embodiment of the present invention will be described while referring to the accompanying drawings.

As shown in FIG. 4, the laser printer P includes the fixing device 1, an image forming mechanism 2, a sheet supply mechanism 3, a sheet discharge mechanism 6, and other components, all housed within a casing 7.

The sheet supply mechanism 3 is disposed upstream from the image forming mechanism 2 in a sheet feed direction. The sheet supply mechanism 3 includes a sheet supply cassette 4 filled with a stack of sheets, a manual sheet supply portion 5 capable of supplying one sheet at a time, and rollers for taking up sheets from the sheet supply cassette 4 or the manual sheet supply portion 5, and supplying the sheets to the image forming mechanism 2. With this configuration, the rollers are driven to rotate to take up a sheet from either of the sheet supply cassette 4 or the manual sheet supply portion 5. While the sheet is sandwiched between the rollers, rotation of the rollers transports the sheet downstream in the sheet transport direction toward the image forming mechanism 2.

The image forming mechanism 2 is for forming images from toner on a paper sheet, which serves as a recording medium. The image forming mechanism 2 is an electrophotographic image is forming device and includes a well-known electrophotographic photosensitive drum, a charging unit, an exposure unit including a laser light source, a developing unit, a transfer unit, and a charge removing unit. To form a toner image on the surface of a sheet, the charging unit charges the surface of the electrophotographic drum sensitive drum. The exposure unit irradiates the surface of the photosensitive drum with laser light to produce an electrostatic latent image on the surface of the photosensitive drum. The developing unit develops the electrostatic latent image into a visible image using toner. The transfer unit transfers the visible toner image onto a paper sheet transported by the sheet supply mechanism 3 from downstream in the sheet transport direction.

The fixing device 1 is for transporting the sheet downstream from the image forming mechanism 2 in a sheet transport direction and, at the same time, heating the sheet to soften or melt the toner onto the sheet, thereby fixing the toner image onto the sheet. The fixing device 1 will be described in greater detail later.

The sheet discharge mechanism 6 is disposed downstream from the fixing device 1 in the sheet transport direction. The sheet discharge mechanism 6 transports a sheet on which the toner image is fixed by the fixing device 1 onto a tray at the top of the laser printer P.

Next, a detailed description will be provided for the fixing device 1. The fixing device 1 is shown in more detail in FIG. 5. As shown in FIG. 5, the fixing device 1 includes a thermal roller 10 and pressure roller 12. As will be described in more detail later, the thermal roller 10 has a tubular aluminum base and a thermal body fixed to the inner surface of the aluminum tube base. The pressure roller 12 is formed from silicone rubber disposed around a metal shaft.

The thermal roller 10 and the pressure roller 12 are disposed in parallel alignment with each other. The pressure roller 12 is rotatably supported on a bearing 13, which is movable toward and away from the thermal roller 10. A spring 14 is provided for urging the bearing 13 in the direction toward the thermal roller 10. With this configuration, the pressure roller 12 and the thermal roller 10 are maintained with their outer peripheral surfaces in pressing contact.

Sheet guides 16, 17 are disposed adjacent to, and on opposite sides of, the thermal roller 10 and the pressure roller 12. When a sheet S is transported from the image forming mechanism 2, which is disposed upstream from the fixing device 1 in the sheet transport direction, the sheet guide 16 guides the sheet S to between where the thermal roller 10 and the pressure roller 12 press against each other. Rotation of the rollers 10, 12 draws the sheet S guided by the sheet guide 16 in between the thermal roller 10 and the pressure roller 12, and further transports the sheet S to the sheet guide 17. The sheet guide 17 in turn guides is the sheet S to the sheet discharge mechanism 6, which is further downstream from the fixing device 1 in the sheet transport direction.

An upper cover 18 is disposed above the thermal roller 10 for preventing the sheet S from bending backwards and again contacting the hot thermal roller 1. An overheat-detection temperature sensor 19 is mounted to the undersurface of the upper cover 18, at a position above the thermal roller 10. The overheat-detection temperature sensor 19 is disposed in confrontation with the outer peripheral surface of the thermal roller 10. If the thermal roller 10 generates an excessive amount of heat due to, for example, run away operation of a control unit of the laser printer P, then the overheat-detection temperature sensor 19 will detect the abnormally excessive temperature and will interrupt supply of power to the thermal roller 10. The overheat-detection temperature sensor 19 can be configured from a temperature fuse or a thermostat Although not shown in the drawings, the fixing device 1 is provided with another temperature sensor in addition to the overheat-detection temperature sensor 19. This other temperature sensor is for detecting surface temperature of the thermal roller 10. Temperature at the surface of the thermal roller 10 is constantly monitored using the temperature sensor, and control is performed accordingly to maintain the temperature at the surface of the thermal roller 10 at a suitable temperature.

As shown in FIG. 6, the thermal roller 10 having the above-described configuration is rotatably supported on bearings 60, 60, which are fixed to the frame of the laser printer P. Also, a drive gear 62 is mounted on one tip of the thermal roller 10. In order to drive the thermal roller 10 to rotate, drive force from a motor (not shown) is transmitted to the drive gear 62.

The drive gear 62 is formed from a compound resin material having excellent resistance to heat, such as a polyphenylene sulfide resin (PPS). The bearings 60, 60 are formed from a compound resin material, such as a polyphenylene sulfide resin (PPS), which serves as a matrix, dispersed with carbon, which serves as electrically-conductive filler. Therefore, the bearings 60, 60 and the drive gear 62 have heat resistance of up to about 250 to 260° C. Therefore, problems such as deformation of the bearings 60, 60 and the drive gear 62 will not occur as long as the thermal roller 10 is used at a normal operation temperature of around 200° C.

The bearings 60, 60 have stable electrical conductivity and are electrically connected to, for example, a metal component connected to ground. Accordingly, the thermal roller 10 is connected to ground via the bearings 60, 60 so that the thermal roller 10 can be prevented from developing a charge. The drive gear 25 can be made from the material used for the bearing 60, dispersed with an electrically-conductive filler in order to prevent the drive gear 25 and the thermal roller 10 from charging.

Sliding contact mechanisms 70, 70 are provided at either end of the thermal roller 10. The sliding contact mechanisms 70, 70 serve as electrodes through which an alternating current or a direct current is supplied to the sheet-shaped heating body 50. Both of the sliding contact mechanisms 70, 70 have substantially the same configuration.

The sliding contact mechanism 70 includes a rotational electrode member 71 and a stationary electrode member 72. The rotational electrode member 71 is fixed to the thermal roller 10 and so rotates integrally with the thermal roller 10. As shown in FIG. 6, the rotational electrode member 71 resiliently contacts the thermal roller 10 from the inside. And the stationary electrode member 72 is attached to the frame of the laser printer P and is supported in resilient contact with the rotational electrode member 71.

The stationary electrode member 27 resiliently deforms to remain in pressing contact with the rotational electrode member 71. Therefore, electrical contact between the stationary electrode member 72 and the rotational electrode member 71 can be maintained while the two slide against each other.

As shown in FIG. 7, the thermal roller 10 is formed from several concentric layers, including, from the outermost layer to the innermost layer, a clinging prevention layer 32, a roller body 31, a film member 134, and a pressure resilient body 36.

The clinging prevention layer 32 is formed onto the outer peripheral surface of the roller body 31 and is provided for preventing toner on the surface of the recording medium from clinging to the thermal roller 10 during fixing operations. The clinging prevention layer 32 can be formed by coating a fluorocarbon resin material to a thickness of about 10 to 30 μm on the outer peripheral surface of the roller body 31. The fluorocarbon resin material should have excellent heat resistance and separation properties.

The roller body 31 serves as a base of the thermal roller 10 and is formed from aluminum in a hollow tube shape.

The film member 134 is disposed at the interior of the roller body 31 and includes three layers: a first heat-resistant insulation layer 33, a thermal layer 34, and a second heat-resistant insulation layer 35 in this order from exterior to interior. The film member 134 is disposed to the exterior of the pressure resilient body 36 and so is supported by being sandwiched between the pressure resilient body 36 and the inner peripheral surface of the roller body 31. It should be noted that "insulation" in the first and second heat-resistant insulation layers 33, 35 refers to electrical insulating properties of these layers.

The thermal layer 34 is configured from a sheet-shaped heating body 50 shown in FIG. 8. The sheet-shaped heating body 50 is a flexible sheet formed from an insulation base 51, which is formed from a polyimide resin film, and an electrical-resistance type heat-generating layer 55 formed on the insulation base 51. The sheet-shaped heating body 50 is inserted into the roller body 31 so that the heat-generating layer 55 faces, and is in contact with, the second heat-resistant insulation layer 35.

The heat-generating layer 55 is formed from a stainless steel foil layer and includes a heating pattern portion 55*a*, a first energization terminal 55*b* connected to one end of the heating pattern portion 55*a*, and a second energization terminal 55*c* connected to the other end of the heating pattern portion 55*a*. The first and second energization terminals 55*b*, 55*c* are electrically connected with the rotational electrode member 71 where the rotational electrode member 71 resiliently contacts the inner surface of the thermal roller 10. With this configuration, the heating pattern portion 55*a* heats up when current flows between the first energization terminal 55*b* and the second energization terminal 55*c*. The heating pattern portion 55*a* of the heat-generating layer 55 can be formed by attaching stainless steel or copper foil, for example, onto the insulation base 51 and then etching the stainless steel or copper foil into a desired pattern.

The temperature distribution of heat generated by the heat-generating layer 55 is adjusted by adjusting the cross-sectional area and the pattern shape of the heating pattern portion 55*a*. That is, regions with a small cross-sectional area generate a larger amount of heat than do regions with a large cross-sectional area. This property is used to adjust the amount of generated heat to produce a uniform temperature distribution at the outer peripheral surface of the thermal roller 1.

As shown in FIG. 8, the heating pattern portion 55*a* of the present embodiment is formed with four different patterns A to D, each having a different cross-sectional area. The cross-sectional area of the patterns A to D increases in order from pattern A to pattern D so that the pattern A generates the most heat and the pattern D generates the least heat The heating pattern portion 55*a* is configured with pattern A at the ends, pattern D in the center, and patterns C and B in between, to generate more heat nearer the ends of the thermal roller 10. This is because the end portions of the thermal roller 10 radiate a greater amount of heat than the central portion. Were the same amount of heat to be generated across the entire thermal roller 10, the surface temperature would be lower at the end portions than at the central portion.

Both of the heat-resistant insulation layers 33, 35 are formed from one or more layers of polyimide resin, which has excellent heat resistance and provides excellent electrical insulation. In order to prevent unexpected short circuits and electric shocks the thermal layer 34 is sandwiched from both sides by the heat-resistant insulation layers 33, 35, and so is electrically partitioned from the roller body 31, the pressure resilient body 36, and other surrounding components. According is to the present embodiment, the first heat-resistant insulation layer 33 is disposed in confrontation with the insulation base 51 of the sheet-shaped heating body 50.

Although the insulation base 51 is described above as a portion of the thermal layer 34, it can also be considered to form the extreme inner layer of the first heat-resistant insulation layer 33. Alternatively, the first heat-resistant insulation layer 33 can be configured from the insulation base 51 itself. However, when the first heat-resistant insulation layer 33 and the insulation base 51 are configured from separate layers, the first heat-resistant insulation layer 33 and the insulation base 51 form a double insulation layer for preventing electrical connection between the heat-generating layer 55 and the roller body 31. With this configuration, if, for some reason the first heat-resistant insulation layer 33 or the insulation base 51 becomes damaged, electrical connection between the roller body 31 and the heat-generating layer 55 can still be prevented.

The second heat-resistant insulation layer 35 prevents direct contact between the heat-generating layer 55 and the pressure resilient body 36. Furthermore, the second heat-resistant insulation layer 35 is configured from a film member made from a polyimide resin with greater heat resistance than the pressure resilient body 36. It is conceivable that, for some reason, the heat-generating layer 55 could generate an unusually high heat at certain portions thereof. However, even if the unusually hot portions of the resistant heater layer exceed the heat resistance temperature of the silicone sponge material of the pressure resilient body 36, the second heat-resistant insulation layer 35 prevents the pressure resilient body 36 from being rapidly heated up to its combustion point. Therefore, by the time the pressure resilient body 36 reaches its thermal breakdown temperature, an abnormally high temperature will be sensed by the overheat-detection temperature sensor 19, which is disposed at the outer periphery of the thermal roller 10. Fires and other such accidents can be prevented. Also, the possibility of the pressure resilient body 35 exceeding the thermal breakdown temperature is exceedingly low as long as the second heat-resistant insulation layer 35 is formed sufficiently thick.

The pressure resilient body 36 is a hollow tube formed from silicone sponge. The pressure resilient body 36 is disposed to the interior of the film member 134. The outer diameter of the pressure resilient body 36 is larger when the pressure resilient body 36 is in an unstressed condition than when the pressure resilient body 36 is disposed in the thermal roller 10. To insert the pressure resilient body 36 into the thermal roller 10, the pressure resilient body 36 is stretched in its axial direction. As a result, the outer diameter of the pressure resilient body 36 shrinks. After the pressure resilient body 36 is disposed inside the thermal roller 10, stretching of the pressure resilient body 36 is stopped. As a result, the pressure resilient body 36 shortens in its axial direction to its original length and expands to its original outer diameter. Therefore, the pressure resilient body 36 presses against the film member 134, thereby sandwiching the film member 134 between the pressure resilient body 36 and the roller body 31. With this configuration, the thermal roller 10 can be assembled without adhesive for fixing heat-generating layer 55 against the roller body 31.

The second heat-resistant insulation layer 35 of the present embodiment is formed from polyimide because polyimide has excellent insulation properties, heat resistance, and workability. However, ceramic materials having excellent heat resistance can be used instead of polyimide.

According to the first embodiment, the second heat-resistant insulation layer 35 is formed from polyimide resin film member disposed between the heat-generating layer 35 and the pressure resilient body 36. When the pressure resilient body 36 is formed from a foam member, such as a silicone sponge, the second heat-resistant insulation layer 35 can be formed by coating the surface of the pressure resilient body 36 with polyimide resin or with a ceramic material having excellent heat resistance. However, when the second heat-resistant insulation layer 35 is coated on the pressure resilient body 36 in this manner, it should be coated in a manner to insure resiliency of the resilient body 36. For example, the second heat-resistant insulation layer 35 can be formed by coating a plurality of layers with predetermined spaces opened therebetween in the peripheral or lengthwise direction around the outer surface of the pressure resilient body 36. Alternatively, the second heat-resistant insulation layer 35 can be formed by droplet shaped material scattered across the outer peripheral surface of the pressure resilient body 36.

A polyimide resin or a ceramic material can be coated to the outer surface of the resistance-type heat-generating body 55 of the heat-generating layer 34. Further, the second heat-resistant insulation layer 35 can be formed by a ceramic sheet formed from fiber shaped pieces of ceramic material, such as aluminum ($AlO_3$) or silicon oxide ($SiO_2$).

The ceramic layer serves not only as an electrical insulation layer but also as a thermally insulating layer with heat resistance against very high temperatures, such as 1000° C. or more. Therefore, even if the heat-generating body generates an excessive heat of 400° C. or more, the ceramic sheet will not ignite. The degree of thermal insulation can be controlled by regulating the thickness of the ceramic layer so that the 300° C. ignition temperature of silicon rubber, from which the pressing member is formed, is not exceeded. Accordingly, thermal break down of the pressing member will not occur so that reduction in the pressing force can be prevented. Further, heat from the heat-generating layer can be effectively transmitted to the roller body so that localized extreme rises in temperatures can be prevented. Also, the power supply to the heat-generating body can be easily cut off by monitoring the temperature of the roller body. This is especially beneficial when the insulation material is made from polyimide, because the power supply can be cut off before the polyimide breaks down.

Because the ceramic sheet has an extremely high thermal insulation property, temperature leaks to the pressure resilient body 36 can be prevented. Further, heat from the heat-generating layer can be effectively transmitted to the roller body. As a result, energy can be prevented from being wastefully consumed.

Further, the second heat-resistant insulation layer 35 desirably has a heat resistance equal to or greater than resistance of the first heat-resistant insulation layer 33. The second heat-resistant insulation layer 35 can be formed from the same material as the first heat-resistant insulation layer 33. However, in this case, the second heat-resistant insulation layer 35 needs to be formed to a thickness that enables the second heat-resistant insulation layer 35 to suppress, to a certain extent, thermal conduction of heat from the heat-generating body 55 to the pressure resilient body 36 and to, at the same time, function effectively as a thermal insulation layer.

Next, an explanation will be provided for a second embodiment of the present invention. FIG. 9 shows a thermal body 10' according to the second embodiment. The thermal body 10' differs from the thermal roller 10 of the first embodiment in that it includes an electrically-conductive resilient body 36' instead of the pressure resilient body 36.

The electrically-conductive resilient body 36' is formed from a thin plate shaped sheet rolled into a cylinder with an outer diameter slightly larger than the inner diameter of the second heat-resistant insulation layer 35, which is disposed at the outer peripheral surface of the electrically-conductive resilient body 36'. The thin plate can be formed from stainless steel, aluminum, or copper. Because all of these materials have sufficient resiliency, any one can sufficiently serve as the resilient body of the present invention. Also, all of these materials have excellent electrical conductivity and have good thermal conductivity. Further, because both are formed in a thin shape, both have low thermal capacity and excellent thermal saturation properties.

FIG. 10(*a*) shows the tube shape of the electrically-conductive resilient body 36'. The electrically-conductive resilient body 36' is cooled to shrink its outer diameter before inserting it in the roller body 31. After being installed, the electrically-conductive resilient body 36' warms up, whereupon its outer diameter expands to its original size. As a result, the electrically-conductive resilient body 36' presses against the first heat-resistant insulation layer 33, the heat-generating layer 34, and the second heat-resistant insulation layer 35, thereby sandwiching the layers 33 to 35 between the electrically-conductive resilient body 36' and the roller body 31. That is to say, the electrically-conductive resilient body 36' functions as a plate spring operating as a pressing body using its own deformation energy.

The thermal roller 10' has excellent thermal conductivity because the electrically-conductive resilient body 36' is formed from a plate spring with excellent electrical conductivity. That is, the electrically-conductive resilient body 36' has better thermal conductivity than the silicone resin material used to make the resilient body 36. Therefore, the electrically-conductive resilient body 36' enhances dispersion of localized excessive heat generated by the heat-generating body. Further. the surface of the electrically-conductive resilient body 36' is smoother than the surface of the foam member that forms the resilient body 36 of the first embodiment. Therefore, the electrically-conductive resilient body 36' presses more uniformly against the surface of the second heat-resistant insulation layer 35 disposed at its outer periphery. Accordingly, the resistance-type heat-generating body 55 is less likely to develop excessive heat at only certain localized positions, which can happen with when pressing force is uneven.

Even if for some reason the resistance-type heat-generating body 55 generates localized excessively high temperatures so that the second heat-resistant insulation layer 35, which is disposed to the interior of the resistance-type heat-generating body 55, heats up locally, the electrically-conductive resilient body 36', which is disposed in the interior of the second heat-resistant insulation layer 35, draws a portion of the localized heat away from the second heat-resistant insulation layer 35. The heat is uniformly dispersed throughout and saturates the entire electrically-conductive resilient body 36'. For this reason, such localized heating will not produce uneven temperatures at the outer surface of the thermal body 10' itself. Therefore, the outer surface of the thermal body 10' can be maintained at a stable heating condition.

Also, the electrically-conductive resilient body 36' will not thermally break down and the film member used as the first heat-resistant insulation layer 33, which is disposed exterior to the resistance-type heat-generating body 55, will not break down and electrical leaks by break down in the insulation will not occur. Because the second heat-resistant insulation layer 35 is interposed between the electrically-conductive resilient body 36' and the resistance-type heat-generating body 55, electrical insulation between the electrically-conductive resilient body 36' and the resistance-type heat-generating body 55 is assured so that short circuits and the like will not occur.

An electrically-conductive resilient body 36'*a* shown in FIG. 10(*b*) can be used instead of the electrically-conductive resilient body 36' shown in FIG. 10(*a*). The electrically-conductive resilient body 36'*a* is formed with an elongated slit in its lengthwise direction. The electrically-conductive resilient body 36'*a* is formed with an outer peripheral diameter slightly larger than the outer peripheral diameter of the second heat-resistant insulation layer 35. Before the electrically-conductive resilient body 36'*a* is inserted into the roller body 31, first, the electrically-conductive resilient body 36'*a* is compressed so as to close the elongated slit and reduce the outer diameter of the electrically-conductive resilient body 36'*a*. The electrically-conductive resilient body 36'*a* is inserted into the roller body 31 while in this condition. After insertion, the electrically-conductive resilient body 36'*a* is released so that the electrically-conductive resilient body 36'*a* reverts to its original large outer diameter. As a result, the electrically-conductive resilient body 36'*a* presses the heat-resistant insulation layer 33 and the heat-generating layer 34 in between itself and the roller body 31.

An electrically-conductive resilient body 36'*b* shown in FIG. 10(*c*) is formed with a spiral shaped slit around its outer periphery. The electrically-conductive resilient body 36'*b* is formed with the outer diameter slightly larger than the inner diameter of the second heat-resistant insulation layer 35. In order to insert the electrically-conductive resilient body 36'*b* into the second heat-resistant insulation layer 35, the electrically-conductive resilient body 36'*b* is wound up in a direction following its outer peripheral surface in order to reduce the outer diameter. After the electrically-conductive resilient body 36'*b* is inserted into the roller body 31, the wound up force is released so that the electrically-conductive resilient body 36'*c* reverts to its large outer diameter and presses the layers 33, 34, 35 between itself and the roller body 31.

It is desirable to form the electrically-conductive resilient bodes 36'*a* and 36'*b* in a shape and size so that the gap at the slotted portion completely closes when the electrically-conductive resilient bodies 36' and 36'C are inserted into the roller body 31.

Further, the electrically-conductive resilient body according to the second embodiment can be formed from a plate-shaped sheet of shape memory alloy. In this case, the electrically-conductive resilient body is inserted into the roller body 31 in a rolled up condition. The electrically-conductive resilient body will attempt to revert to its original shape while in the roller body 31. This force presses the outer layers against the roller body 31.

Also, the electrically-conductive resilient body according to the second embodiment can be formed from a simple rectangular shape thin plate that is rolled up and inserted into the roller body 31. In this case, the length of the thin plate before it is rolled up is desirably longer than the inner circumference of the roller body 31 to insure that layers exterior to the electrically-conductive resilient body are pressed against the roller body 31 with a uniform force.

Next, a thermal roller 10" according to a third embodiment of the present invention will be explained while referring to FIGS. 11 and 12. As shown in FIG. 11, the thermal roller 10" includes the roller body 31 and clinging prevention layer 32 in the same manner as the thermal rollers 10 and 10' of the first and the second embodiments. However, the thermal roller 10" differs from the thermal rollers 10, 10' of the first and the second embodiments in the use of a heat-resistant insulation sheet 40, which is disposed within the roller body 31 in a rolled up condition.

As shown in FIG. 12, the heat-resistant insulation sheet 40 includes an insulation base 41 formed from a polyimide resin film member. The insulation base 41 is divided into a pressing region X: a heat-generating region Y; and an insulation region Z.

A resilient body 46 is formed on the pressing region X The resilient body 46 has a rectangular shape and is formed form a thin plate of stainless steel. The resilient body 46 has a property of attempting to resiliently return to its original shape when deformed by a force.

A resistance-type heat-generating body 44 is formed on the heat-generating region Y and on edge portions of the pressing region X. The resistance-type heat-generating body 44 includes a heating pattern portion 44*a,* a first energization terminal 44*b* connected to one end of the heating pattern portion 44*a,* and a is second energization terminal 44*c* connected to the other end of the heating pattern portion 44*a*. The first and second energization terminals 44*b,* 44*c* of the resistance-type heat-generating body 44 are electrically connected to the rotational electrode member 71 where the rotational electrode member 71 resiliently contacts the inner surface of the thermal roller 10". With this configuration, the heating pattern portion 44*a* heats up when current flows between the first energization terminal 44*b* and the second energization terminal 44*c*. The heating pattern portion 44*a* of the heat-generating layer 44 can be formed by attaching a thin plate of stainless steel foil onto the insulation base 41 and then etching the stainless steel foil into a desired pattern.

In the same manner as in the first embodiment, the temperature distribution of heat generated by the heat-generating layer 44 is adjusted by adjusting the cross-sectional area and the pattern shape of the heating pattern portion 55*a*. As shown in FIG. 12, the heating pattern portion 44*a* of the present embodiment is formed with four different patterns A to D, each having a different cross-sectional area. The cross-sectional area of the patterns A to D increases in order from pattern A to pattern D so that the pattern A generates the most heat and the pattern D generates the least heat. The heating pattern portion 55*a* is configured with pattern A at the ends, pattern D in the center, and patterns C and B in between, to generate more heat nearer the ends of the thermal roller 10. With this configuration, temperature distribution of heat generated by the heat-generating layer 44 can be adjusted to produce a uniform heat across the entire outer peripheral surface of the thermal roller 10".

It should be noted that the resilient body 46 and the resistance-type heat-generating body 44 are formed at the same time by attaching stainless steel or copper foil sheet onto the insulation base 41 and etching the stainless steel or copper foil sheet into a desired pattern. For this reason, compared to when the resilient body 46 and the resistance-type heat-generating body 44 are formed separately and then attached to the insulation base 41, the heat-resistant insulation sheet 40 can be formed easier and more rapidly and operations can be more efficiently performed.

The insulation region Z is a rectangular region formed from a portion of the insulation base 41 in other words, nothing is formed on the insulation region Z. It should be noted that nothing is formed on the undersurface of the insulation base 41.

As shown in FIG. 11, the heat-resistant insulation sheet 40 configured in this manner is mounted within the roller body 31 in a rolled up condition. The heat-resistant insulation sheet 40 is rolled up so that the pressing region X is disposed to the most interior side and the heat-generating region Y and the insulation region Z are disposed in this order exterior to the pressing region X. It should be noted that the pressing region X, the heat-generating region Y, and the insulation region Z should be formed to a length that, when in this rolled up condition, equals or exceeds the inner circumference of the roller body 31.

When the heat-resistant insulation sheet 40 is mounted into the roller body 31 in the rolled up condition described above, the resilient body 46 of the pressing region X, which is disposed interior to other regions Y, Z, pressingly maintains regions Y, Z sandwiched between itself and the roller body 31. Because the insulation region Z is disposed exterior to the other regions X, Y, electrical insulation between the resistance-type heat-generating body 44 of the heat-generating region Y and the roller body 31 is assured.

In this way, the single heat-resistant insulation sheet 40 performs a variety of functions. That is, the insulation region Z performs an insulation function, the heat-generating region Y performs a heat generating function, and the pressing region X performs a pressing and fixing function. Therefore, to mount the heat-resistant insulation sheet 40 into the roller body 31, the heat-resistant insulation sheet 40 merely needs to be rolled up and inserted into the roller body 31 and to complete mounting processes. For this reason, assembly of the thermal roller 10" can be simplified and can be performed with great efficiency and with fewer components than the thermal rollers 10, 10' of the first and second embodiments.

In this way, the resistance-type heat-generating body 44 and the resilient body 46 are provided to only a single surface of the insulation base 41. The heat-resistant insulation sheet 40 configured in this manner is mounted in the roller body 31 with the resistance-type heat-generating body 44 and the resilient body 46 disposed to the interior of the insulation base 41. As a result, the regions Y and Z of the insulation base 41 are both disposed between the resistance-type heat-generating body 44 and the inner surface of the roller body 31. This double insulation layer increases effectiveness of insulation. In the same way, the pressing region X of the insulation base 41, which supports the resilient body 46, is interposed between the resilient body 46 and the resistance-type heat-generating body 44. This forms an insulation layer so that proper electrical insulation is guaranteed.

Although the third embodiment describes the resistance-type heat-generating body 44 and the resilient body 46 as being formed from an integral thin plate of stainless steel, the resilient body 46 and the resistance-type heat-generating body 44 can be formed from separate members. The resilient body 46 and the resistance-type heat-generating body 44 need not be formed from stainless steel but could be formed from any other electrically-conductive material such as copper or aluminum.

The resilient body 46 can be dispensed with if the insulation base 41 is formed with sufficient thickness and resiliency to perform the pressing and fixing function of the resilient body 46. In this case, a portion of the insulation base 41 can serve to fix the heat-resistant insulation sheet 40 from the inside against the roller body 31.

A variety of modifications and alternate configurations other than the pressing region X are conceivable as a pressing means for pressing the heat-resistant insulation sheet from the inside outward toward the inner peripheral surface of the roller body. For example, a foam resin member that generates pressing force by generation of bubbles from inside can be used. Alternatively, a freely stretchable resilient body, such as a silicone sponge member according to the first embodiment, can be used to obtain pressing force by inserting it into the roller body Further, a plate spring according to the second embodiment formed into a cylindrical shape can be used to obtain pressing force by it inserting into the roller body.

The insulation region Z can be dispensed with if the insulation base 41 has sufficient insulation properties to perform the insulation function of the insulation region Z. In this case, the resistance-type heat-generating body can be disposed in the roller body to the interior of the heat-resistant insulation sheet member. In this case because the insulation base 41, which supports the heat-generating body 44, is interposed between the heat-generating body 44 and the interior peripheral surface of the roller body 31, insulation between the heat-generating body 44 and the roller body 31 can be sufficiently insured.

Because the heat-resistant insulation sheet is configured only from a heat-generating region and a pressing region, the heat-resistant insulation sheet can be configured in a small size Accordingly, the heat-resistant insulation sheet is easy to produce and assembly operations for inserting the heat-resistant insulation sheet into the roller body can be simplified and operations can be efficiently performed.

While the invention has been described in detail with reference to three specific embodiments thereof, it would be apparent to those skilled in the art that various changes and modifications may be made therein without departing from the spirit of the invention, the scope of which is defined by the attached claims.

For example, although the fixing device 1 is described in the embodiment as being disposed in the laser printer P, the fixing device 1 can be used in any image forming device that includes an image forming mechanism that forms images by impinging thermally meltable recording material onto a recording medium, such as a paper sheet. For example, the fixing device 1 can be used in copiers, printers, or facsimile machines to fix images formed by the image forming mechanism onto the recording medium.

The image forming device is not limited to an electrophotographic device which use toner. For example, a hot melt ink jet device, which uses thermally meltable ink, can be used Also, the thermal rollers 10, 10', 10" can be formed from other materials than aluminum As long as the material has good thermal conductivity, then whether or not it is an electrically-conductive material is not important.

What is claimed is:

1. A thermal roller comprising:

a cylindrical roller body formed with a hollow interior;

a first heat-resistant insulation layer disposed in the hollow interior of the roller body;

a resistance-type heat generating body disposed interior to the first heat-resistant insulation layer;

a second heat-resistant insulation layer disposed interior to the resistance-type heat generating body; and a resilient body disposed interior to the second heat-resistant insulation layer and pressing the second heat-resistant insulation layer toward the roller body with sufficient resilient force to fix the first heat-resistant insulation layer, the resistance-type heat generating body, and the second heat-resistant insulation layer in place with respect to the roller body.

2. A thermal roller as claimed in claim 1, wherein the resilient member is formed from an electrically conductive material.

3. A thermal roller as claimed in claim 2, wherein the resilient member is formed with greater thermal conductivity than is the second heat-resistant insulation layer.

4. A thermal roller as claimed in claim 2, wherein the resilient member is formed with greater heat resistance than is the second heat-resistant insulation layer.

5. A thermal roller as claimed in claim 2, wherein the resilient member is formed from a metal.

6. A thermal roller as claimed in claim 1, wherein the second heat-resistant insulation layer is formed with greater heat resistance than is the resilient body.

7. A thermal roller as claimed in claim 1, wherein the second heat-resistant insulation layer is formed from a sheet of polyimide resin.

8. A thermal roller as claimed in claim 1, wherein the second heat-resistant insulation layer is formed from a ceramic material.

9. A thermal roller as claimed in claim 9 further comprising a temperature sensor, provided external to the roller body, that detects temperature at a surface of the roller body.

10. A thermal roller comprising:

a cylindrical roller body formed with a hollow interior;

a first heat-resistant insulation layer disposed in the hollow interior of the roller body;

a resistance-type heat generating body disposed interior to the first heat-resistant insulation layer;

a second heat-resistant insulation layer disposed interior to the resistance-type heat generating body, the second heat-resistant insulation layer having higher heat-resistance than the first heat-resistant insulation layer; and a resilient body disposed interior to the second heat-resistant insulation layer and pressing the second heat-resistant insulation layer toward the roller body with sufficient resilient force to fix the first heat-resistant insulation layer, the resistance-type heat generating body, and the second heat-resistant insulation layer in place with respect to the roller body.

* * * * *